United States Patent [19]

Hansen et al.

[11] 4,237,349

[45] Dec. 2, 1980

[54] COMPACT MOVING-COIL PICKUP OF LOW WEIGHT AND HIGH QUALITY

[75] Inventors: Bjarne S. Hansen, Fredensborg; Robert Gudmandsen, Taastrup, both of Denmark

[73] Assignee: Ortofon Manufacturing A/S, Valby, Denmark

[21] Appl. No.: 973,922

[22] Filed: Dec. 28, 1978

[30] Foreign Application Priority Data

Dec. 29, 1977 [JP] Japan ..... 52-160954

[51] Int. Cl.[3] ..... H04R 9/12

[52] U.S. Cl. ..... 179/100.41 D; 179/100.41 K

[58] Field of Search ..... 179/100.41 D, 100.41 K, 179/100.41 Z

[56] References Cited

U.S. PATENT DOCUMENTS

| | | | |
|---|---|---|---|
| 2,034,872 | 3/1936 | Keller | 179/100.41 D |
| 2,133,815 | 10/1938 | Harrison | 179/100.41 D |
| 3,133,161 | 5/1964 | Neumann | 179/100.41 D |
| 3,956,598 | 5/1976 | Kawakami et al. | 179/100.41 D |
| 3,963,880 | 6/1976 | Ikeda | 179/100.41 D |
| 4,011,417 | 3/1977 | Kageyama et al. | 179/100.41 K |
| 4,090,039 | 5/1978 | Mori et al. | 179/100.41 D |
| 4,145,582 | 3/1979 | Nakatsuka | 179/100.41 D |
| 4,161,631 | 7/1979 | Matsuda | 179/100.41 D |

FOREIGN PATENT DOCUMENTS

| | | |
|---|---|---|
| 2555846 | 7/1976 | Fed. Rep. of Germany . |
| 2616389 | 10/1976 | Fed. Rep. of Germany . |

OTHER PUBLICATIONS

Philips' Technische Rundschau, Feb. 1940, pp. 29–36.
Philips' Technische Rundschau, Jan. 1941, pp. 8–11.

*Primary Examiner*—Robert S. Tupper
*Assistant Examiner*—Donald McElheny, Jr.
*Attorney, Agent, or Firm*—Fleit & Jacobson

[57] ABSTRACT

In a moving-coil pickup having a flat, wound armature which is fixed to a stylus arm and is movably mounted in a magnet field produced by one or more permanent magnets, said magnet or magnets is/are so arranged as to define a relatively short tube within which the armature is mounted.

8 Claims, 4 Drawing Figures

COMPACT MOVING-COIL PICKUP OF LOW WEIGHT AND HIGH QUALITY

BACKGROUND OF THE INVENTION

The present invention relates to moving-coil pickups of the type having a relatively flat, wound armature which is fixed to a stylus arm and is movably mounted in a magnetic field produced by one or more permanent magnets.

DESCRIPTION OF PRIOR ART

In the past magnetic materials, for example materials containing samarium and cobalt, havve been developed which have a very high energy capacity as compared with more conventional materials such as alnico. Said new materials show the characteristic feature that maximum magnet energy is obtained when the length of the magnet is short relatively to the cross-sectional dimensions thereof.

The main object of the present invention is to provide a moving-coil pickup which takes full advantage of the above mentioned feature about certain new magnetic materials to attain a compact, effective pickup of very low weight and high quality.

SUMMARY OF INVENTION

This object is obtained according to the invention by a pickup of the type referred to in which the permanent magnet or magnets has/have the form of at least one or more parts of a relatively short tube at least partly enclosing and being substantially coaxial with the armature. Apart from the stylus arm and means for pivotally supporting the armature the whole pickup structure thus defined is contained within the outer contours of the tubular magnet or of the part-tubular magnet or magnets supplemented with the missing part or parts, which magnet may be very small, and the weight of the pickup is correspondingly low.

According to one embodiment of the invention yokes may be placed on the ends of the magnet or magnets and have portions which extend towards the axis and form two spaced, substantially parallel pole faces, between which the armature is mounted. Such yokes cause in a manner known per se a concentration of the magnetic field and hence an increase of the sensitivity of the pickup.

This effect may according to a further feature of the invention be increased by an arrangement in which the pole face forming portions of the yokes extend axially into the cavity defined by the magnet or magnets.

In case of a tubular magnet this magnet may have any suitable cross-sectional form such as circular or square or combinations of said forms.

BRIEF DESCRIPTION OF DRAWINGS

The invention will be further described in the following with reference to the drawings, in which.

DETAIL DESCRIPTION

Figure 1:
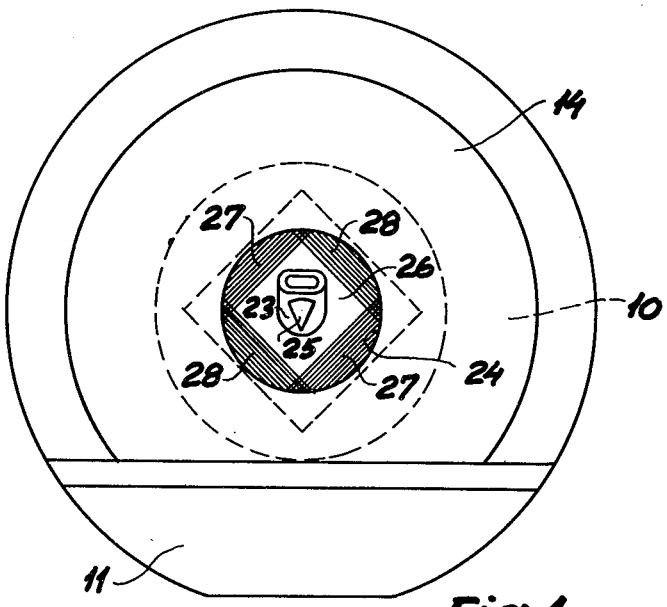
FIG. 1 is a front elevation of an embodiment of the pickup according to the invention.
Figure 2:
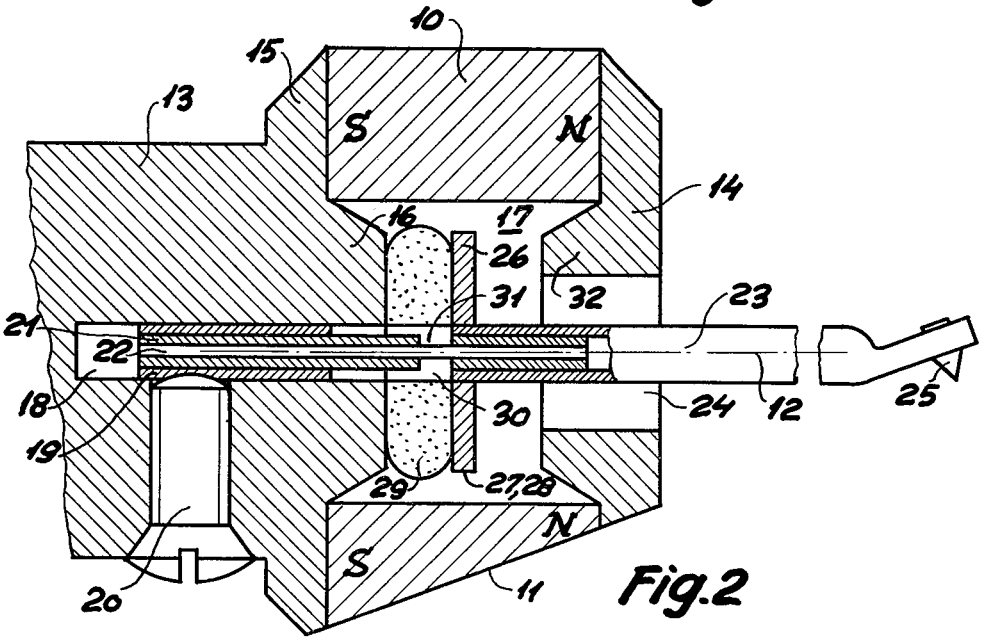
FIG. 2 shows a vertical, longitudinal partial section through the pickup shown in FIG. 1.

Referring first to FIGS. 1 and 2, 10 is a tubular generally cylindrical permanent magnet, preferably consisting of a samarium-co-balt alloy, the lower portion of which has been cut away leaving a flat lower surface 11 which forms an angle with the axis 12 of the magnet. On each end of the magnet a yoke 13 and 14 respectively consisting of soft iron or another magnetically conducting material is mounted.

The yoke 13 is a generally cylindrical body provided at one end with an annular flange 15, one side of which is conformal with and engages the adjacent end surface of the magnet 10. The yoke 13 is further provided with an axial projection 16 in the form of a truncated cone extending from the circular inner edge of the magnet 10 into the cavity 17 defined by said magnet.

In an axial bore 18 in the inner end of the yoke 13 a sleeve 19 is held firmly by means of a screw 20 which is screwed into a threaded hole extending radially from the bore 18. To the inner side of the sleeve 19 a nickel coating 21 on a piece of piano wire 22 is secured. The nickel coated wire 22 extends into and is secured to the inner side of the inner end of a tubular stylus arm 23 extending through an opening 24 in the front yoke 14 and carrying a stylus 25 on its free, outer end. On the inner end of the stylus arm 23 a flat, generally square armature 26 is secured. Said armature consists of magnetically soft material with high permeability and carries two pairs of coils 27 and 28 substantially at right angles to each other. Between the armature 26 and the end face of the yoke projection 16 a rubber pad 29 having a center hole 30 for the passage of the nickel coated wire 21, 22 is compressed by tension in the wire 22. In a small area 31 adjacent the inner face of the armature 26 the nickel coating 21 is interrupted to provide a pivot point allowing the armature to pivot in all directions.

The front yoke 14 is generally disc shaped and has an inner annular surface which is conformal with and engages the adjacent end face of the magnet 10. Like the rear yoke 13 it is provided with a truncated cone shaped, inwardly extending projection 32 which together with the first projection 16 define an air-gap in which the armature is pivotally mounted by the means described above.

The cavity 17 is preferably filled with damper oil consisting of a suspension of magnetic particles in oil. The combined effect of the magnetic field on said particles and the adhesion of the oil thereto keeps the damper oil within the cavity irrespective of the opening 24.

The yokes 14 and 15 have the effect of concentrating the magnetic field produced by the permanent magnet 10 in the air gap, in which the armature is movably mounted. However, it is possible to dispense with said yokes and still obtain a satisfactory sensitivity of the pickup structure, the windings 27 and 28 of the armature 26 cooperating in a way known per se with the magnetic field to produce stereo signals in response to movements of the armature.

Figure 3:
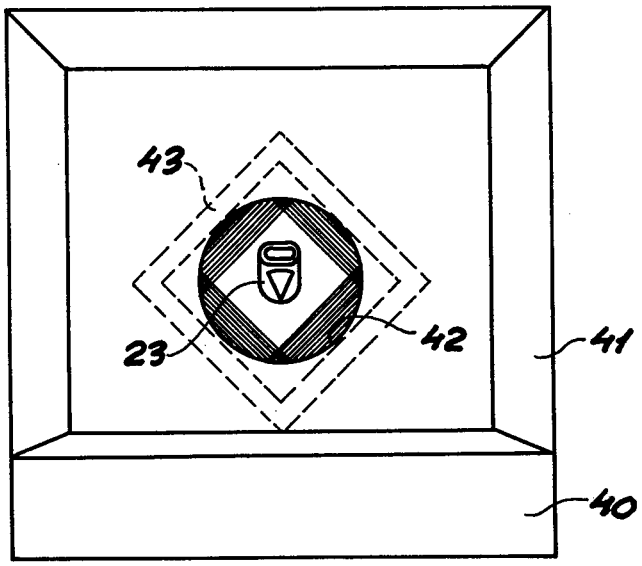
FIG. 3 is a front elevation of another embodiment of the invention.

The embodiment of the invention shown in front elevation in FIG. 3 differs from that shown in FIGS. 1 and 2 and described above in that the tubular magnet is generally square in cross-section with vertical and horizontal sides instead of cylindrical. As in the first described embodiment, the lower part of the magnet here designated by 40 has been cut away along a plane which is somewhat inclined relatively to the axis of the structure. The peripheral portion of the front yoke, here designated by 41, is conformal with the adjacent end face of the magnet and is provided with a circular opening 42, through which the stylus arm 23 passes. Said stylus arm and the armature carried thereby as well as the pivotal mounting thereof are arranged in the same manner as previously described in connection with FIGS. 1 and 2 and shall not be further described here.

Also the opening, here designated by 43, of the tubular magnet 40 is square in cross-section, this latter square being turned 45° with respect to the square defining the outer contour of the cross-section of the magnet, so that the sides of the opening 43 are substantially parallel to the edges of the armature.

Other cross-sectional shapes than circular and square may be contemplated as well as various combinations of different outer and inner cross-sections. It is even possible to cut away an axially extending strip of the magnet, which thus may take the form of a channel member partly enclosing the armature. Still another possibility is to cut away more axially extending strips of the magnet leaving a number of rod shaped magnets so arranged as to define a tube or part of a tube.

Figure 4:
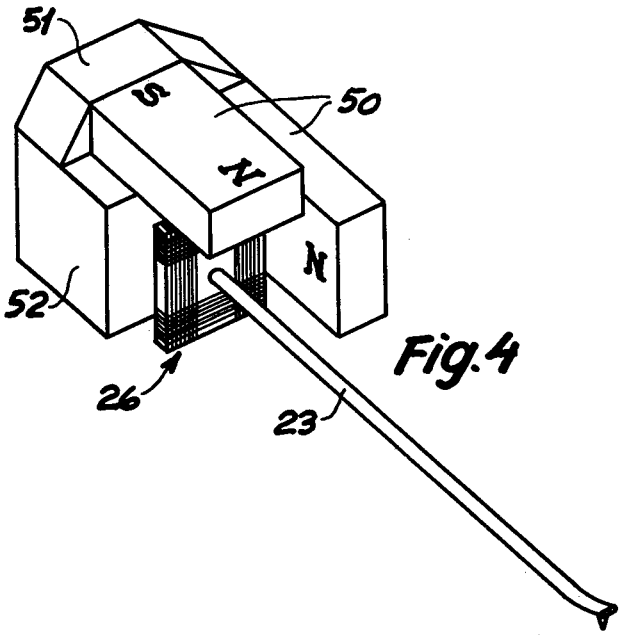
FIG. 4 is a perspective view showing still another embodiment of the invention.

FIG. 4 shows such a structure comprising two relatively broad bar magnets 50 so arranged as to form approximately half of a square-section tube. Abutting one end of the magnets is a yoke 51 which is provided with a projection 52 extending towards the armature and stylus arm assembly 23,26 and supporting said assembly in the manner shown in FIG. 2 and described above. If so desired a corresponding yoke may be provided at the front end of the magnets 50 which latter yoke would be provided with an opening for the passage of the stylus arm 23 instead of the means for supporting the armature assembly.

Other modifications and alterations may be made within the scope of the invention as defined by the appendent claims.

We claim:

1. A moving-coil pickup comprising a relatively flat armature including at least one winding, a stylus arm to which said armature is fixed, and at least one permanent magnet for producing a magnetic field in which said armature is tiltably mounted, wherein said at least one permanent magnet comprises at least one part of a relatively short tube at least partly enclosing, and being substantially coaxial with, the armature.

2. A pickup according to claim 1, said at least one permanent magnet having an axis, comprising yokes placed on the ends of said at least one permanent magnet, wherein said yokes have portions which extend toward the axis and form two spaced substantially parallel pole faces between which the armature is mounted.

3. A pickup according to claim 2, wherein said at least one permanent magnet defines a cavity, and wherein the portions of the yokes extend axially into the cavity defined by the at least one permanent magnet.

4. A pickup according to claim 1, wherein said at least one permanent magnet defines a cavity, and wherein said at least one permanent magnet is tubular, and wherein said at least one permanent magnet defines a cross-section of the cavity which is circular.

5. A pickup according to claim 1, wherein said at least one permanent magnet defines a cavity, and wherein said at least one permanent magnet is tubular, and wherein said at least one permanent magnet defines a cross-section of the cavity which is square with substantially vertical and horizontal diagonals in the operating position of the pickup.

6. A pickup according to claim 5, wherein said at least one permanent magnet defines a cross-section having an outer contour which is rectangular, and wherein said cavity has a contour, and wherein said at least one permanent magnet has a rectangular contour, said cross-sectional square contour of said cavity and said rectangular contour of said at least one permanent magnet forming an angle of approximately 45° with respect to each other.

7. A pickup according to claim 1, wherein said at least one permanent magnet is tubular, and wherein said at least one permanent magnet defines a cross-section having an outer contour which is circular.

8. A pickup according to claim 1, wherein said at least one permanent magnet is tubular, and wherein said at least one permanent magnet defines a cross-section having an outer contour which is rectangular.

* * * * *